US008173915B2

(12) United States Patent
Manjunath et al.

(10) Patent No.: US 8,173,915 B2
(45) Date of Patent: May 8, 2012

(54) IGNITION KEY SWITCH APPARATUS WITH IMPROVED SNAP ACTION MECHANISM

(75) Inventors: Niranjan Manjunath, Karnataka (IN); Bindu Philip, Karnataka (IN); Mahesh Kumar Nagrajan, Karnataka (IN)

(73) Assignee: Honeywell International Inc., Morristown, NJ (US)

( * ) Notice: Subject to any disclaimer, the term of this patent is extended or adjusted under 35 U.S.C. 154(b) by 725 days.

(21) Appl. No.: 12/332,134

(22) Filed: Dec. 10, 2008

(65) Prior Publication Data

US 2010/0140060 A1 Jun. 10, 2010

(51) Int. Cl.
*H01H 27/06* (2006.01)

(52) U.S. Cl. ..... 200/43.08; 200/408

(58) Field of Classification Search ..... 200/43.08, 200/408, 451

See application file for complete search history.

(56) References Cited

U.S. PATENT DOCUMENTS

| | | | | | |
|---|---|---|---|---|---|
| 1,377,145 | A * | 5/1921 | Briggs et al. | ..... | 200/43.08 |
| 1,710,912 | A * | 4/1929 | Andrew | ..... | 200/43.08 |
| 1,740,225 | A * | 12/1929 | Cummins | ..... | 200/7 |
| 2,258,846 | A * | 10/1941 | Courtney | ..... | 200/43.08 |
| 3,187,130 | A * | 6/1965 | Bye et al. | ..... | 200/451 |
| 3,194,933 | A * | 7/1965 | Ramstetter | ..... | 200/451 |
| 3,261,937 | A * | 7/1966 | McVicker | ..... | 200/451 |
| 3,270,156 | A * | 8/1966 | Stewart | ..... | 200/408 |
| 3,522,394 | A * | 7/1970 | Bellrose | ..... | 200/43.08 |
| 3,735,080 | A * | 5/1973 | Andresen | ..... | 200/451 |
| 3,739,114 | A * | 6/1973 | Palman | ..... | 200/43.08 |
| 4,154,992 | A | 5/1979 | Aspman | ..... | 200/44 |
| 4,891,477 | A * | 1/1990 | Matsuzawa | ..... | 200/61.64 |
| 6,492,606 | B1 | 12/2002 | MacLean | ..... | 200/400 |
| 6,552,287 | B2 | 4/2003 | Janniere | ..... | 200/406 |
| 6,768,412 | B2 | 7/2004 | Becka et al. | ..... | 337/36 |
| 7,030,325 | B2 * | 4/2006 | Blossfeld et al. | ..... | 200/11 R |
| 7,081,593 | B2 * | 7/2006 | Hopkins | ..... | 200/402 |
| 2006/0131155 | A1 | 6/2006 | Hopkins | ..... | 200/402 |
| 2008/0164134 | A1 | 7/2008 | Ochiai et al. | ..... | 200/83 P |

FOREIGN PATENT DOCUMENTS

WO WO02/43093 A1 5/2002

* cited by examiner

*Primary Examiner* — Elvin G Enad
*Assistant Examiner* — Lisa Homza
(74) *Attorney, Agent, or Firm* — Ingrassia Fisher & Lorenz, P.C.

(57) ABSTRACT

An ignition key switch apparatus having a compact size, high current capability, and a snap action mechanism. A pre-loaded snap spring can be configured to include a fixed end attached to an anchor and a free end attached to a movable contact operable between normal and actuated positions. A cam can be utilized to convert a rotary motion at a key interface into a linear movement of a plunger for snap spring blade actuation. The unique pre-loaded snap spring generates a fast (e.g., instantaneous) movement from an open to a closed position and vice versa upon application/removal of a load to reduce the effect of arcing on associated contacts and conductors. The pre-loaded snap spring also ensures that the movable contact does not remain in any intermittent position, other than the two extreme positions given at any position of the plunger.

6 Claims, 7 Drawing Sheets

IGNITION KEY SWITCH APPARATUS WITH IMPROVED SNAP ACTION MECHANISM

TECHNICAL FIELD

Embodiments are generally related to key-operated ignition switches for use with automotive vehicles. Embodiments are also related to snap action devices for ignition key switch applications.

BACKGROUND OF THE INVENTION

Various types of locks have been utilized in connection with door locking mechanisms and ignition systems associated with a vehicle. Traditionally, vehicle door locking mechanisms and ignition systems are operated utilizing a mechanical key. Vehicle operators typically utilize keys for locking or unlocking vehicle doors and rotating an ignition start, such as an ignition system tumbler, in order to start the vehicle. An ignition key switch controls power to a number of vehicle accessories, thereby preventing accessories from running down the car's battery when the vehicle is parked for an extended period of time. The ignition switch also serves the greater purpose of connecting a starter to the battery, which allows the battery to send a powerful surge of electricity in the starter when the vehicle is being started.

Typical ignition key switches possess four positions such as, for example, "off", "accessories", "on" and "start". Some vehicles, however, possess two off positions, off and lock; one turns off the car and the other allows the key to be removed from the ignition. When the key is turned to the accessories position, certain accessories, such as the radio, can be powered. Accessories that utilize too much power, however, such as window motors, remain off in order to prevent the vehicle's battery from being drained. The accessories position utilizes the least amount of battery power when the engine is not running. The on position turns on all of the vehicle's system, including systems such as the fuel pump, powered window motors, etc because this is the position the ignition switch remains in while the car's engine is running. The start position can be spring loaded so that the ignition switch will not remain in place when the key is released.

When the key is inserted into an ignition switch lock cylinder and turned to the start position, the starter engages. Likewise, when the key is released, it returns to the on position, cutting power to the starter. Conventional ignition switches can be designed to switch a lower voltage of 12V and a current of 10-15 A. The same ignition switch can be utilized in the context of a 24V system; however, the current is derated to 5 Amps. Such ignition switches are unable to switch high current such as, for example, 25 Amps at 25 VDC over an enhanced life cycle of 60000 cycles. The majority of prior art key ignition switches utilizes a sliding arrangement contact make and break mechanism. Such an arrangement is susceptible, however, to sustained arcing as the make/break mechanism speed is dependent on the rotation of the key by the user. Slowing the rotation arcing endures for a prolonged time, which in turn leads to failure of the switch.

Based on the foregoing it is believed that a need exists for an improved ignition key switch apparatus having a compact size, high current, and a snap action mechanism. A need also exist for an improved snap spring to make/break contacts and to reduce the effect of arcing on the contacts and conductors.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved ignition key switch.

It is another aspect of the present invention to provide for an improved snap action mechanism having a compact size and a high current capability for use with ignition key switch applications.

It is a further aspect of the present invention to provide for an improved snap spring to make/break contacts and to reduce the effect of arcing on contact and conductor components.

The aforementioned aspects and other objectives and advantages can now be achieved as described herein. An ignition key switch apparatus having a compact size, high current capability and a snap action mechanism is disclosed. A pre-loaded snap spring can be configured to include a fixed end attached to an anchor and a free end attached to a movable contact operable between normal and actuated positions. A cam can be utilized to convert a rotary motion at a key interface into a linear movement of a plunger for snap spring blade actuation. The unique pre-loaded snap spring generates a fast (i.e., instantaneous) movement from an open to a closed position and vice versa upon application/removal of a load to reduce the effect of arcing on associated contacts and conductors. The pre-loaded snap spring also ensures that the movable contact does not remain in any intermittent position other than the two extreme positions given at any position of the plunger.

The pre-loaded snap spring comprises an 'A' type snap spring with a force balance type snap action mechanism and/or a 'C' type snap spring with a centre type snap action mechanism. Full insertion of the key physically pushes the plunger at the inner end of the ignition switch, causing start switch actuation, provided that the key is valid. Once the engine starts, the key is released and is returned to the "on" position. A downward depression of the plunger causes the actuating lever via an actuating force to move a hinged portion of the actuating lever upward along an arc thereby causing compression of the snap spring, resulting in a snap-action contact between the movable contact and at least one of two stationary contacts for completion of an electrical circuit thereof.

The spring remains in an over travel state as the plunger continues to impress upon the snap spring after actuation. At this state, a small movement may occur between the movable contact and the stationary contact. The movement in the spring can assist in breaking any "sticky" welds caused by the bounce between the contacts. Once the plunger is depressed, it can attain an operational point and the free end of the snap spring can move over to the other extreme rest position instantaneously. The contact tips of the switch can be configured from metal such as, for example, silver tin oxide, in order to provide good arc quenching properties.

DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
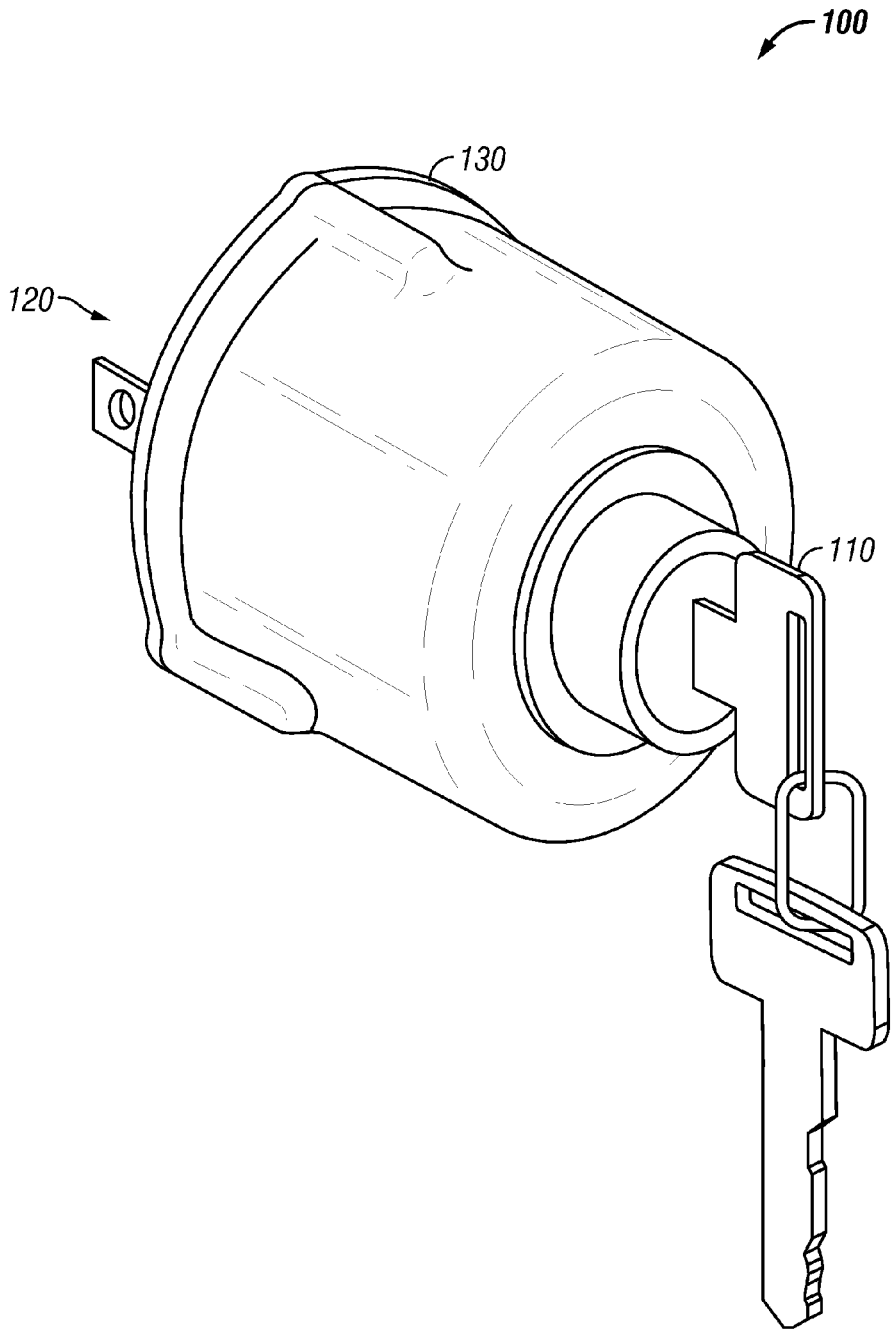
FIG. 1 illustrates a perspective view of an ignition key switch apparatus, in accordance with a preferred embodiment.

FIG. 1 illustrates a perspective view of an ignition key switch apparatus 100 with an ignition key 110, which can be implemented in accordance with a preferred embodiment. The ignition key switch apparatus 100 generally includes a lock cylinder 130 associated with an electronic switch 120 into which the ignition key 110 can be inserted to internally change the position (such as on, off, accessories, start, etc.) of the switch apparatus 100. The switch apparatus 100 controls power to many of the vehicle components, preventing components from running down the battery when the vehicle is parked for long period of time. The term "vehicle component" may refer to any component or system of components within a vehicle. For example, a vehicle component may refer to a stereo, an air-conditioning system, one or more lights, an ignition system, a lock, a seat system, an overhead console, or other various components or systems within a vehicle.

Additionally, the term "key" refers to any access, unlocking, or component-starting device that may or may not have a specific identity. A specific identity may be an authorization code, a cut pattern, a magnetic field of a predetermined strength, or other identification parameter known in the art. A key may be active, such that it generates a transmission signal or magnetic field. A key may be passive such that it simply has a specific cut pattern, size, length, style, reflective pattern, bar code, or other passive identification or authorization parameter known in the art. A key may be a key fob with an insertable portion that may be inserted into a lock assembly. A key may be of various sizes, shapes, styles, and forms as are known in the art. The lock cylinder 130 enables access to or ignition of one or more vehicle components upon identification, authorization, and position determination of the key 110.

Figure 2:
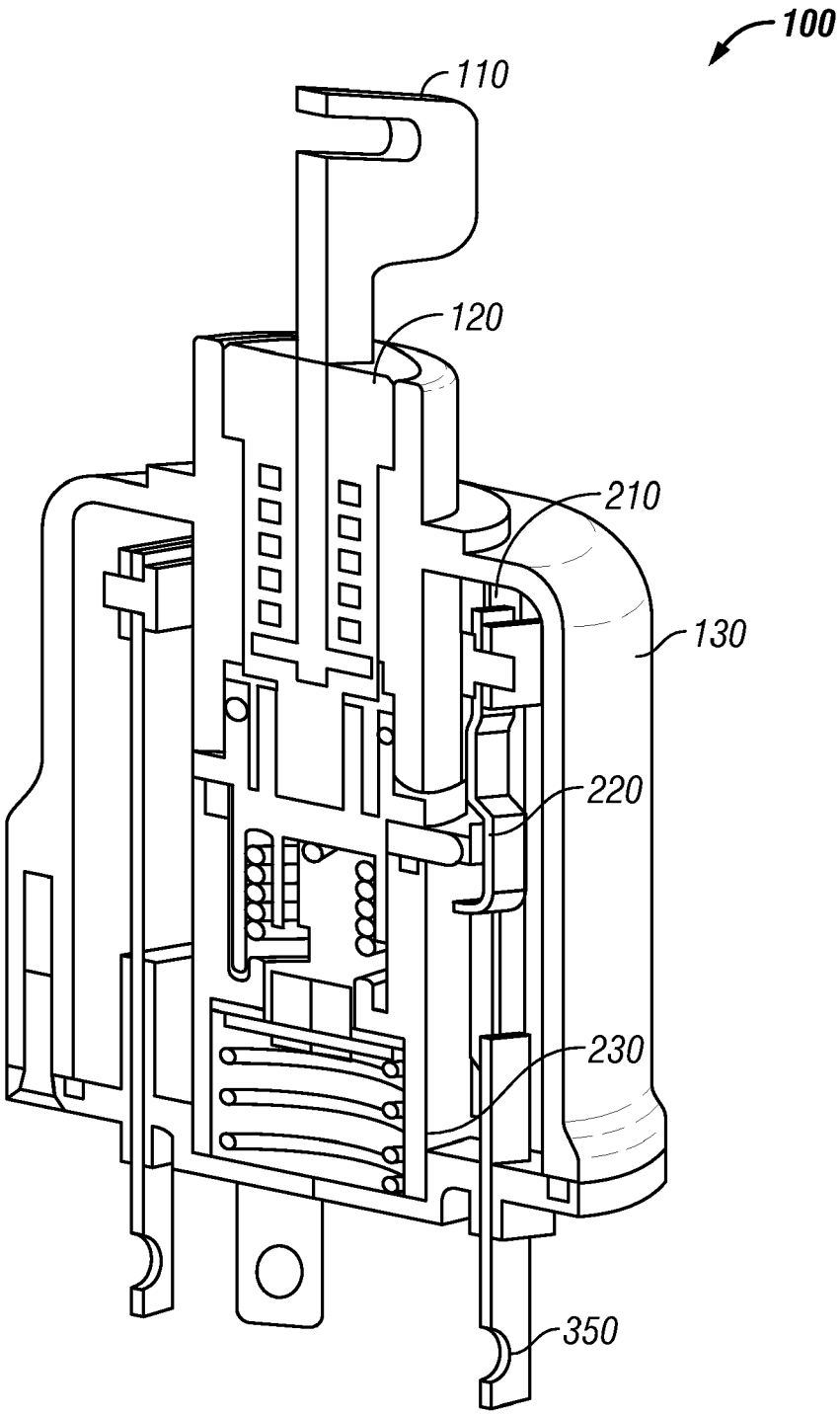
FIG. 2 illustrates a cross sectional view of the ignition key switch apparatus, which can be implemented in accordance with a preferred embodiment.

FIG. 2 illustrates a cross sectional view of the ignition key switch apparatus 100 associated with an 'A' type snap spring assembly 210, which can be implemented in accordance with a preferred embodiment. Note that in FIGS. 1-8, identical or similar parts are generally indicated by identical reference numerals. The present invention relates to an electrical rotary switch, generally designated as 100, particularly for use as an ignition switch in vehicles for controlling the starting, ignition and accessory functions. For example, the ignition key switch 100 may have any number of rotational or translational positions, each position corresponding to an activation of one or more vehicle components. Upon inserting and actuating the key 110 in the lock cylinder 130, the electronic switch 120 identifies, authorizes, and determines the position of the key 110. The key 110 may even be in the form of a toggle switch having several different positions, such that the keys, upon being inserted into the lock assemblies, may be toggled into the different positions. For simplicity, the present invention is primarily described with respect to rotationally actuated keys and lock assemblies, although other actuated keys and lock assemblies may be utilized.

Figure 3:
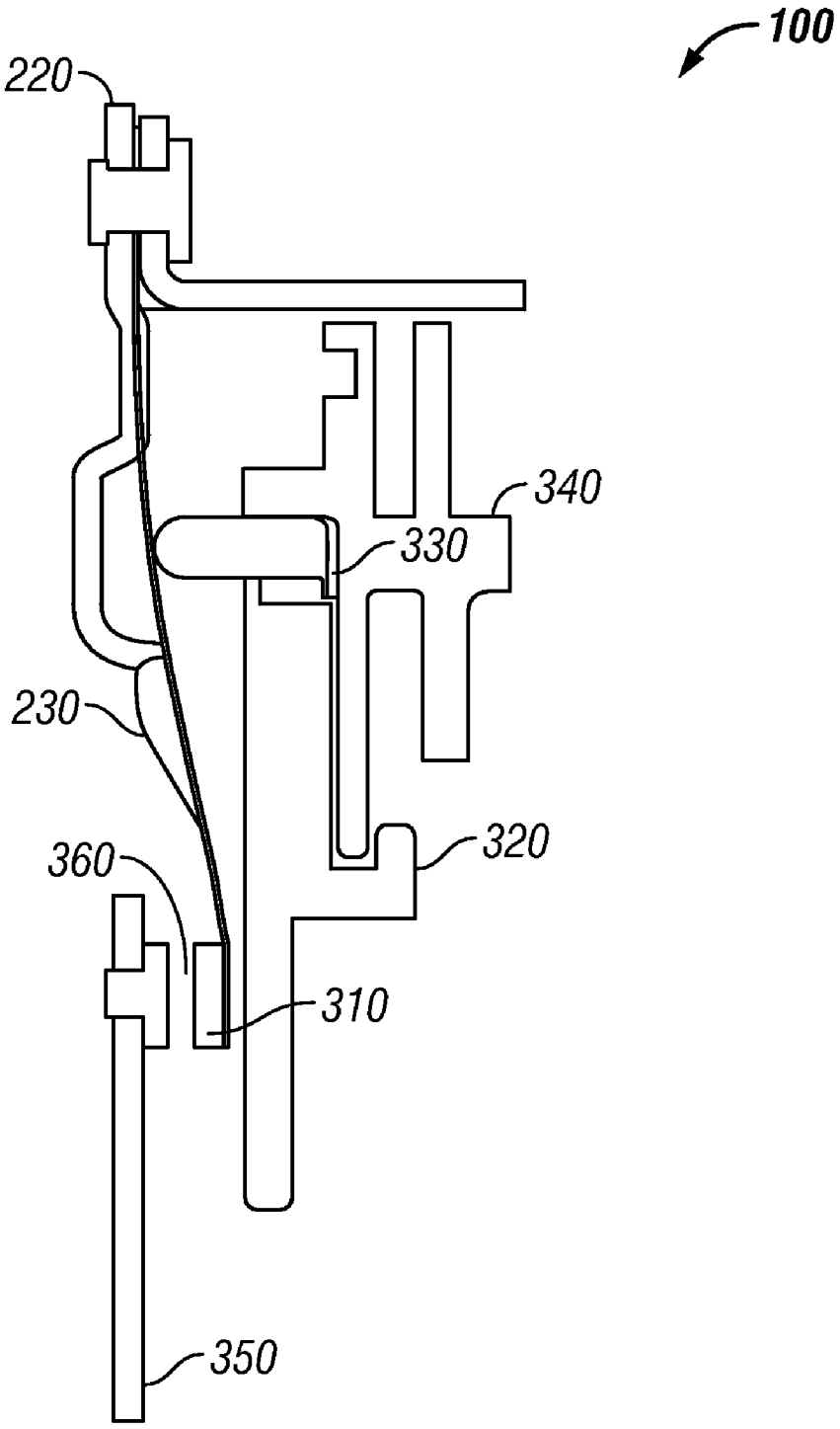
FIG. 3 illustrates an assembled view of the ignition switch apparatus comprising an 'A' type snap spring assembly, which can be implemented in accordance with a first embodiment.

The 'A' type snap spring assembly 210 includes a snap spring 230 that can be utilized to break/make contacts in the ignition switch apparatus 100. The snap spring 230 has one end secured to an anchor 220 and the free end affixed to a movable contact 310, as shown in FIG. 3. The snap spring 230 is preferably formed of an electrically conductive material, which is flexible to allow the snap spring 230 to create a curvature in the free end. In a preferred embodiment, the snap spring 230 can be formed of, for example, 0.003-inch thick C17410HT beryllium copper. Other suitable materials include silver plating, gold flashing, or pure copper clad metal in combination with a spring base metal to form a laminated spring material. The particular material or combination of materials can be selected according to desired electrical conductivity characteristics; however, they should not be interpreted in any limiting manner. That is, it will be apparent to those skilled in the art that other materials can be utilized as desired without departing from the scope of the invention.

The snap spring 230 of the snap spring assembly 210 can be configured as a bi-stable pre-loaded spring, which differentiates current art performance from many prior art mechanisms such as, for example, a butt contact type mechanism. The entire 'A' type spring assembly 210 can be located into the lock cylinder 130 of the ignition key switch 100. The unique pre-loaded snap spring 230 ensures there is an instantaneous movement from open to closed position and vice versa upon application/removal of a load. The instantaneous movement of the spring 230 can help to reduce the effect of arcing on contact 310 of the ignition key switch 100. Note that the embodiments discussed herein should not be construed in any limited sense. That is, it can be appreciated that such embodiments reveal details of the structure of a preferred form necessary for a better understanding of the invention and may be subject to change by skilled persons within the scope of the invention without departing from the concept thereof.

FIG. 3 illustrates an assembled view of the ignition key switch apparatus 100 comprising an 'A' type snap spring assembly 210, which can be implemented in accordance with a first embodiment. The ignition switch 100 includes a hollow cylindrical housing 320 mounted perpendicular to the lock cylinder 130. The plunger 330 can be disposed within the housing 320 and is retained in place by the side of the lock cylinder 130. Electrical contacts 310 and 350 can be mounted to the surface of a slightly necked-down portion of the housing 320 opposite to the lock cylinder 130 and at diametrically opposed locations. The switch apparatus 100 also includes a common movable contact 310 that can press against a lower normally open stationary contact 350. Insulators (not shown) can be mounted between the electrical contacts 310 and 350 and the housing 320 thereby inhibiting the completion of the electrical circuit through the housing 320.

The snap spring 230 have a fixed end that is attached to the anchor 220 and a free end movable between the stationary contacts 350. The snap spring 230 can be configured from a conductive material so that the current supplied to the stationary support 350 flows through the spring 230. The snap spring 230 also can be configured to include an actuation point disposed between the fixed and free end positioned to engage the plunger 330 or other actuating device, which selectively applies force against the actuating point to drive the snap spring 230 from the normal to the actuated position. The ignition switch 100 also includes a cam element 340 that operates against the snap spring 230 via a plunger 330. The snap spring 230 can be configured to include contacts located at the end and projections with which the plunger 330 can engage. The contact tips such as contact tip 360 are preferably configured from, for example, silver tin oxide in order to provide good arc quenching properties. The cam 340 can be utilized to convert the rotary motion at the key 110 into a linear movement of the plunger 330 for snap spring actuation.

Figure 4:
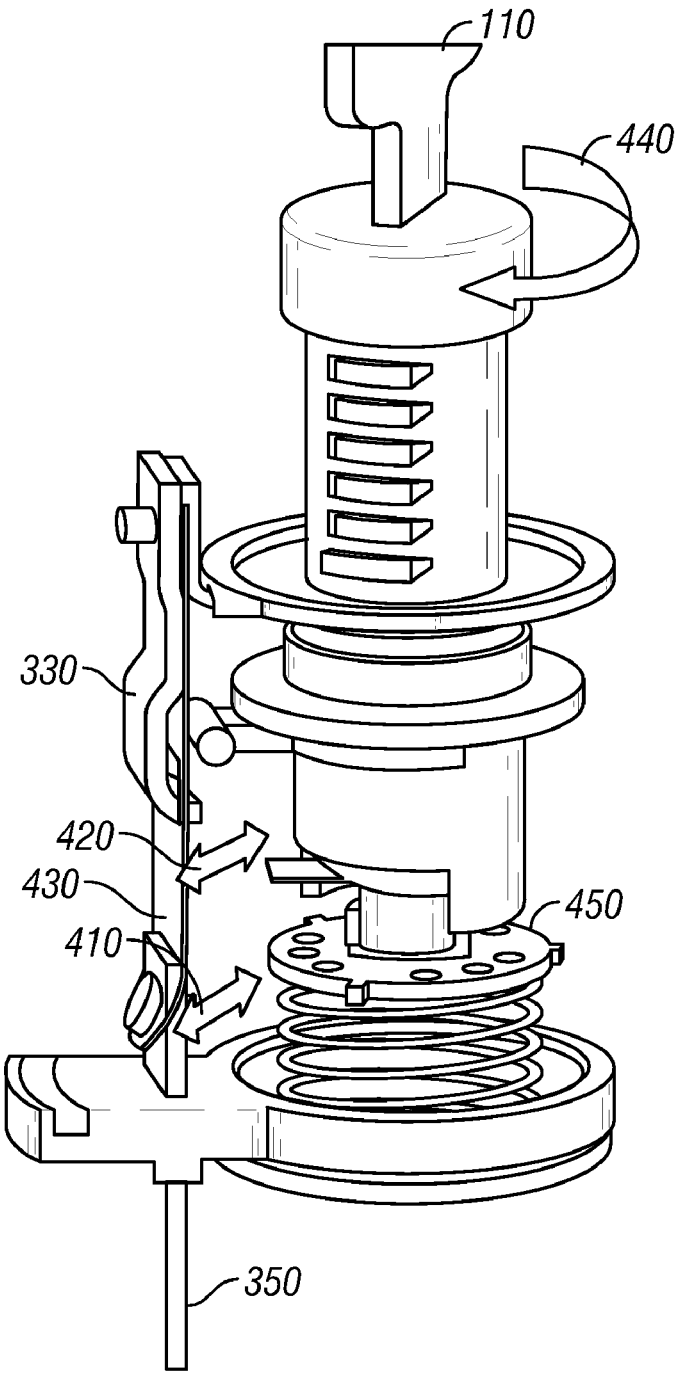
FIG. 4 illustrates a perspective vertical alignment of the ignition key switch apparatus, which can be implemented in accordance with a preferred embodiment.

FIG. 4 illustrates a perspective vertical alignment of the ignition key switch apparatus 100, which can be implemented in accordance with a preferred embodiment. Note that one end of the snap spring 230 is kept hold by the anchor 220, whereas the other end is fixed to the movable contact 310. The ignition key 110 can be rotated in a rotational direction as illustrated by arrow 440. The cam 340 converts the rotary motion at the key 110 into a linear movement of the plunger 330 for snap spring actuation. The movement of the plunger 330 and the snap spring 230 are illustrated by arrows 420 and 410 respectively.

Figure 5:
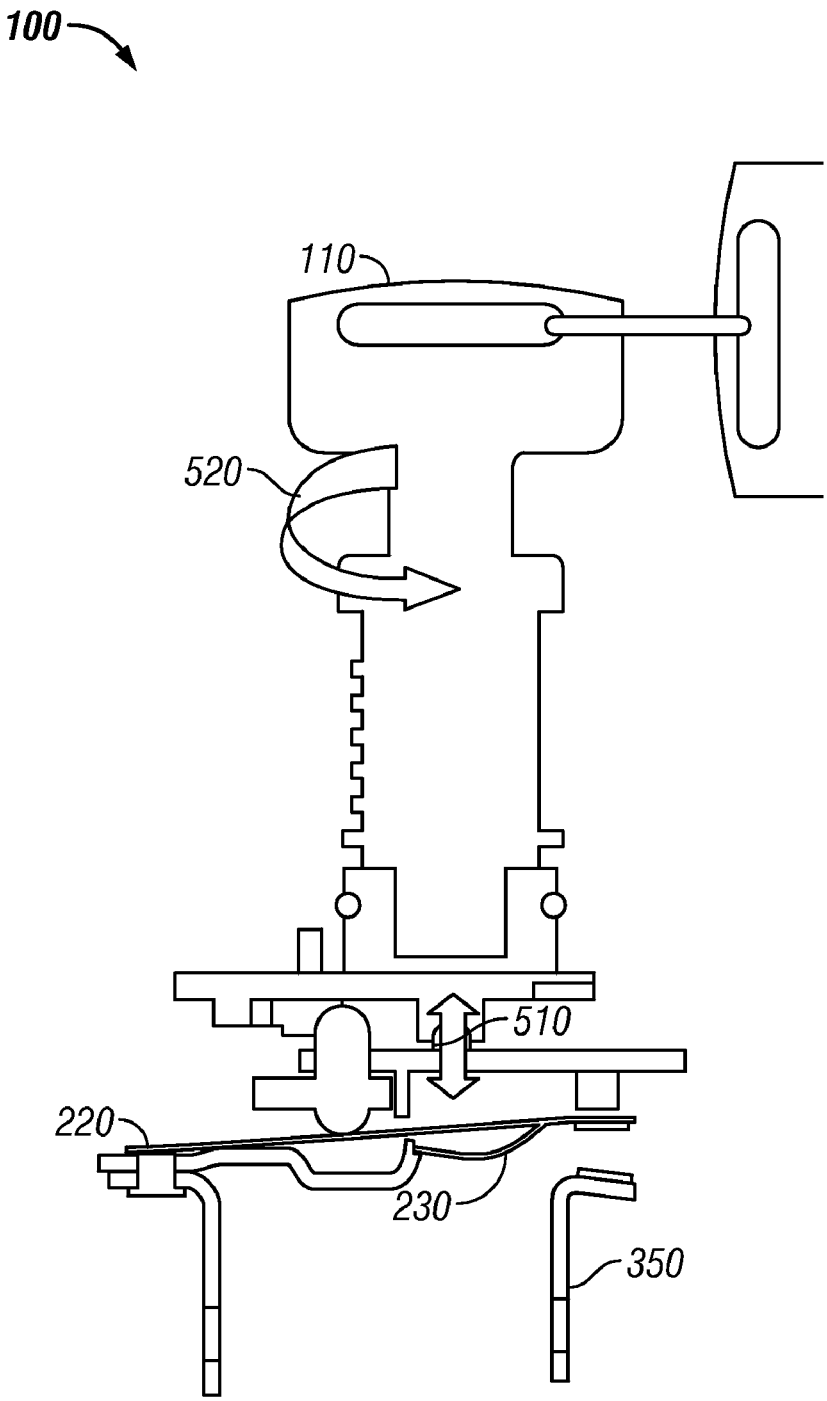
FIG. 5 illustrates a perspective horizontal alignment of the ignition key switch apparatus, which can be implemented in accordance with a preferred embodiment.

FIG. 5 illustrates a perspective horizontal alignment of the ignition key switch 100, which can be implemented in accordance with a preferred embodiment. The movement of the plunger 330 and the key are illustrated by arrows 520 and 510 respectively. A downward depression of the plunger 330 causes an actuating lever 430 via an actuating force to move a hinged portion of the actuating lever 430 upward along an arc thereby causing compression of the snap spring 230, resulting in a snap-action contact between the movable contact 310 and at least one of two stationary contacts 350 for completion of an electrical circuit thereof. The switch apparatus 100 moves in a continuous instantaneous movement from open to closed position and vice versa upon application/removal of load when the actuation force is resilient and of a desired rate. The switch apparatus 100 can function as a negative-rate switch, wherein a highest plunger force occurs at a free position and a lowest plunger force occurs at a full over-travel position thereof.

Contact force diminishes to zero as the switch apparatus 100 approaches the operating point, the plunger position at which the switch changes electrical state from the normally-closed (NC) circuit to the normally-open circuit (NO). Similarly, contact force decreases to zero as the switch apparatus 100 approaches its release point, the plunger position at which the switch changes state from the NO circuit back to the NC circuit. The snap spring 230 also ensures that the movable contact 310 does not stay in any intermittent position other than the two extreme positions given at any position of the plunger 330. The snap spring 230 is in over travel state as the plunger 330 continues to impress upon the snap spring 230 after actuation. At this state there can be a small movement between the movable contact 310 and a stationary contact 350. This movement can help to break any sticky welds caused due to make or contact bounce between the contacts 310 and 350.

Once the plunger 330 is depressed, it reaches an operation point and the free end of the snap spring 230 can move over to the other extreme rest position instantaneously. The ignition switch 100 also comprises a detent mechanism 450 for holding the key 110 thereof in a set position. When the key 110 is released from the detent mechanism 450, a spring-biased centering mechanism normally moves the key 110 to a neutral position automatically. The neutral or centered position of the key 110 can be normally determined by accurately machining retainers for the centering spring. Note that the force-balance action can be created by one of a variety of known mechanisms, such as an over-center type mechanism or a force-balance mechanism.

Figure 6:
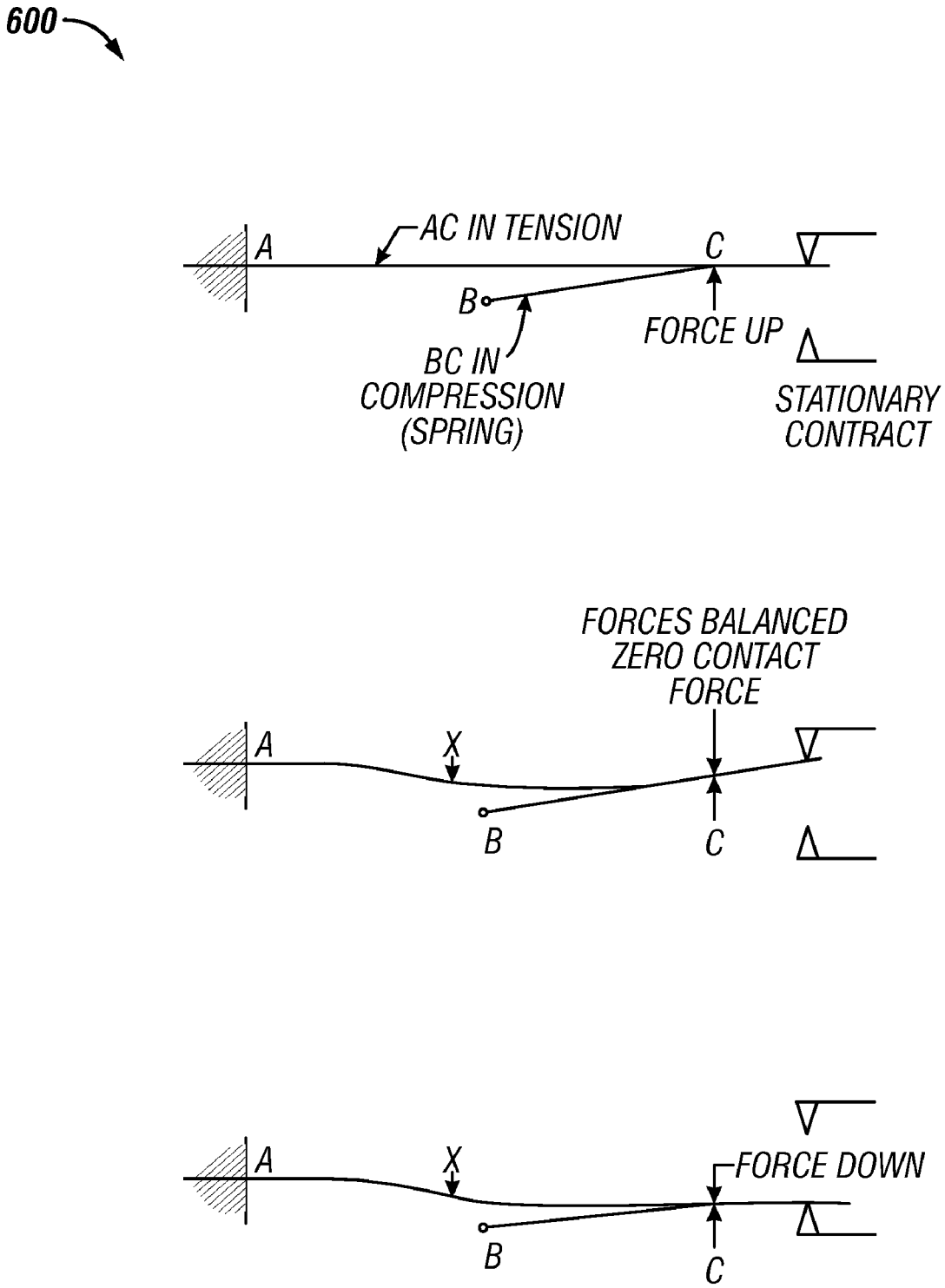
FIG. 6 illustrates a schematic view of the ignition key switch apparatus illustrating force balance type snap action, in accordance with a first embodiment.

FIG. 6 illustrates a schematic view of the ignition key switch apparatus 100 illustrating force balance type snap action 600, in accordance with a first embodiment. Snap action is the property of a switch such that the moving contact 310 accelerates without added travel of the plunger 330 beyond that travel required to separate the contacts 310 and 350. The compressive force provided by the snap spring 230 assists in the downward movement of the snap spring 230. The contact force against the normally-closed stationary contact is at a maximum when the mechanism is at its free position.

Once the actuating force exceeds the free position force, the plunger 330 begins to move with a decreasing resistance. When the plunger 330 reaches the operate position, point B, the contact force drops to zero and the snap-spring assembly 210 accelerates from the normally-closed stationary contact to the normally-open stationary contact. As the plunger 330 is further depressed, the resisting force continues to drop until it reaches a minimum at the over travel position. The contact force against the normally-open stationary contact is a maximum when the mechanism is in the over-travel position.

Figure 7:
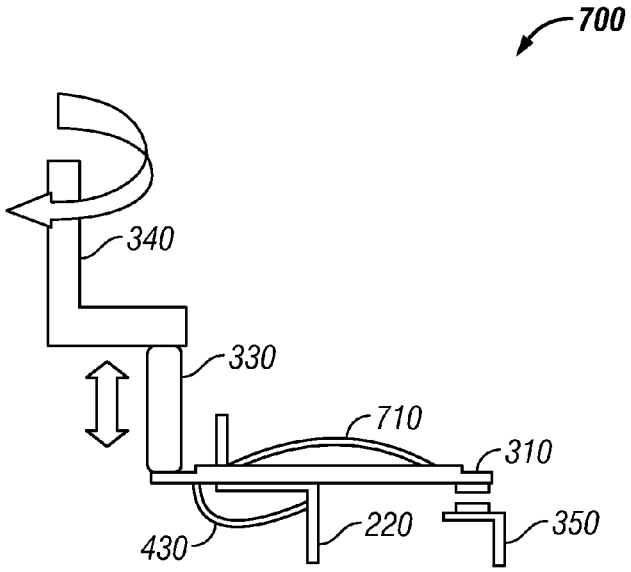
FIG. 7 illustrates a perspective view of the ignition key switch apparatus comprising 'C' type snap spring assembly, which can be implemented in accordance with a second embodiment.
Figure 8:
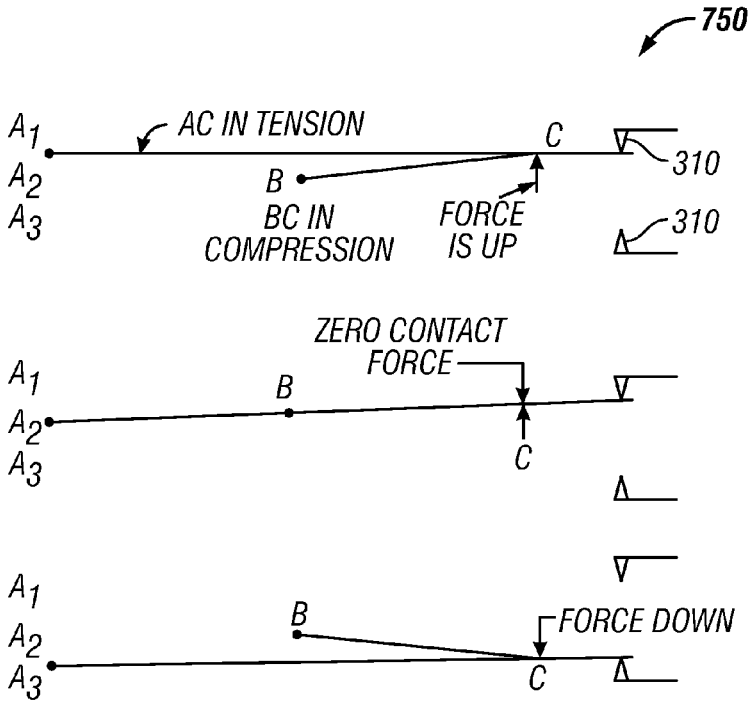
FIG. 8 illustrates a schematic view of the ignition key switch apparatus illustrating over the center type snap action, in accordance with a second embodiment.

FIG. 7 illustrates a perspective view of the ignition switch 700 comprising a 'C' type snap spring 710, which can be implemented in accordance with a second embodiment. Again, as a reminder, in FIGS. 1-8 identical or similar parts or elements are referred to by identical reference numerals. A 'C' type snap spring 710 is connected to the movable contact 310, which can come into contact with stationary contact 350 (i.e., an NO terminal). FIG. 8 illustrates a schematic view of the ignition key switch 700 illustrating over the center type snap action 750, in accordance with a second embodiment. The rapid motion of the contacts 310 and 350 from one position to another position, or their return, is relatively independent of the rate of travel of the actuator. The acceleration of the moving contact is partially dependent upon the velocity of the plunger 330. If the plunger 330 reaches the operating or release point, the movable contact 310 immediately transfers to its opposite position without further travel of the plunger 330.

The compact, high current, snap-action switch apparatus 100 and/or 700 described herein thus do not move until a required actuation or de-actuation force has been attained. When the actuating force is resilient in nature and of an appropriate rate, the switch apparatus 100 and/or 700 moves in a continuous, uninterrupted motion from one position of stability to another. The switch contact force is at a maximum when the plunger 330 is in either the free position or the full over travel position. The unique pre-loaded springs 230 and 710 ensure that a fast (i.e., instantaneous) movement is present from the "open" to "closed" positions and vice versa upon application/removal of a load, in order to reduce the effect of arcing on the associated contact and conductor components. The pre-loaded snap springs 230 and 710 also ensure that the movable contact 310 does not remain in any intermittent position other than the two extreme positions given at any position of the plunger 330.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. An ignition key switch apparatus with an improved snap action mechanism, comprising:

a lock cylinder having an opening and to slidably receive a key therein;

an anchor disposed within and coupled to the lock cylinder in cantilever fashion, and having a fixed end and a free end, the fixed end coupled to the lock cylinder;

a pre-loaded snap spring disposed within the lock cylinder and having a fixed end attached to the fixed end of the anchor, an intermediate portion coupled to the free end of the anchor, and a free end having a movable contact attached thereto, wherein said pre-loaded snap spring generates an instantaneous movement from an open position to a closed position and vice versa upon application or removal of a load to reduce an effect of arcing on a plurality of contacts;

a plunger disposed within the lock cylinder and engaging the snap spring, the plunger configured to selectively implement linear movement to a plurality of positions to thereby apply or remove the load to the snap spring, and a cam disposed within said lock cylinder and configured to convert rotary motion at a key interface to the linear movement of said plunger to effectuate the snap spring actuation, wherein said snap spring ensures said movable contact does not remain in any intermittent position other than at least two extreme positions at any position of said plunger.

2. The apparatus of claim 1 wherein said pre-loaded snap spring comprises a snap spring blade with a force balance type snap action mechanism.

3. The apparatus of claim 1 wherein said pre-loaded snap spring comprises a snap spring blade with an over-center type snap action mechanism.

4. The apparatus of claim 1 further comprising:

an actuating lever associated with said plunger and said movable contact and at least two stationary contacts, wherein one of said at least two stationary contacts comprises a normally open contact and another of said at least two stationary contacts comprises a normally closed contact.

5. The apparatus of claim 4 wherein said movable contact and said at least two stationary contacts each comprise a metal for arc quenching.

6. The apparatus of claim 5 wherein said metal comprises silver tin oxide.

* * * * *